US005560381A

United States Patent [19]

Edwards

[11] Patent Number: 5,560,381

[45] Date of Patent: Oct. 1, 1996

[54] STAINLESS STEEL COVER FOR PLASTIC SPRAY ARM

[75] Inventor: James M. Edwards, Kinston, N.C.

[73] Assignee: White Consolidated Industries, Inc., Cleveland, Ohio

[21] Appl. No.: 536,090

[22] Filed: Sep. 29, 1995

[51] Int. Cl.[6] ..... B08B 3/02

[52] U.S. Cl. ..... 134/176; 134/179; 134/198; 134/201; 239/104; 239/288; 239/251

[58] Field of Search ..... 134/56 D, 57 D, 134/58 D, 198, 200, 201, 176, 179, 180; 239/104, 127.1, 288, 288.3, 251, 265.11

[56] References Cited

U.S. PATENT DOCUMENTS

| | | | |
|---|---|---|---|
| 2,905,393 | 9/1959 | Federighi et al. . | |
| 3,292,645 | 12/1966 | Braden et al. | 134/57 D |
| 3,334,750 | 8/1967 | Ullman, Jr. . | |
| 3,348,775 | 10/1967 | La Flame . | |
| 3,669,132 | 6/1972 | Mamrose | 134/58 D |
| 3,941,139 | 3/1976 | Spiegel . | |
| 3,949,772 | 4/1976 | Hartman | 134/200 |
| 4,064,887 | 12/1977 | Geiger et al. . | |
| 4,227,546 | 10/1980 | Bergeson | 134/58 D |
| 4,387,496 | 6/1983 | Spiegel . | |
| 4,416,300 | 11/1983 | Jordan . | |
| 4,509,687 | 4/1985 | Cushing . | |
| 4,991,611 | 2/1991 | Jarvis et al. . | |
| 5,267,582 | 12/1993 | Purtilo . | |
| 5,320,120 | 6/1994 | Hoffman et al. . | |
| 5,333,631 | 8/1994 | Kirkland et al. . | |

FOREIGN PATENT DOCUMENTS

| | | | |
|---|---|---|---|
| 2505643 | 11/1982 | France | 134/58 D |
| 4036930 | 5/1982 | Germany | 134/198 |
| 2199734 | 7/1988 | United Kingdom | 134/198 |
| 2200535 | 8/1988 | United Kingdom | 134/198 |
| 2204482 | 11/1988 | United Kingdom . | |

*Primary Examiner*—Frankie L. Stinson
*Attorney, Agent, or Firm*—Pearne, Gordon, McCoy & Granger

[57] ABSTRACT

The present invention provides a wash arm assembly for a dishwasher which includes a molded plastic wash arm and a stainless steel cover. The plastic wash arm has a top surface, lateral surfaces, and a bottom surface and the stainless steel cover wraps over the top surface of the plastic wash arm, around the lateral surfaces of the plastic wash arm, and over a portion of the bottom surface of the plastic spray arm to hold the cover on the spray arm. The top surface of the plastic wash arm defines a series of wash jets and the stainless steel cover defines openings aligned with the wash jets so that the metal cover does not interfere with the wash jets.

9 Claims, 3 Drawing Sheets

16
54
58
48
52
60
56
22
24
50
54
46
64

16
54
58
48
52
60
56
22
70
50
54
46
72

STAINLESS STEEL COVER FOR PLASTIC SPRAY ARM

BACKGROUND OF THE INVENTION

1. Field of the Invention

The present invention generally relates to a rotatable wash arm for a dishwasher and, more particularly, to an improved wash arm assembly which includes a plastic wash arm and a metal cover.

2. Description of Related Art

Automatic dishwashers which pump wash water through rotatable wash arms for distribution of the wash water throughout the washing chamber, to wash articles placed therein, have traditionally utilized wash arms manufactured from stainless steel material. Stainless steel wash arms, however, can require a large number of parts and therefore a large amount of manufacturing tooling and assembly. This is especially true when the wash arm includes extensions such as, for example, extensions for clean-out jets for cleaning a filter at a pump inlet. As a result, wash arms are often manufactured from a thermoplastic material in order to realize a reduction in manufacturing costs. Thermoplastic wash arms, however, have a different appearance than the traditional stainless steel wash arms and may not have a pleasing aesthetic appearance to the operator of the dishwasher. Accordingly there is a need in the art for an improved wash arm which provides a pleasing aesthetic appearance at a reduced manufacturing cost.

SUMMARY OF THE INVENTION

The present invention provides an improved wash arm assembly for a dishwasher which overcomes at least some of the above-described problems. The wash arm assembly includes a plastic wash arm and a metal cover. The plastic wash arm has a top surface, lateral surfaces, and a bottom surface and the metal cover wraps over the top surface and around the lateral surfaces of the plastic wash arm. In preferred embodiments, the metal cover extends over a portion of the bottom surface to hold the metal cover on the plastic wash arm. The metal cover provides a pleasing aesthetic appearance to the wash arm at a reduced cost.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
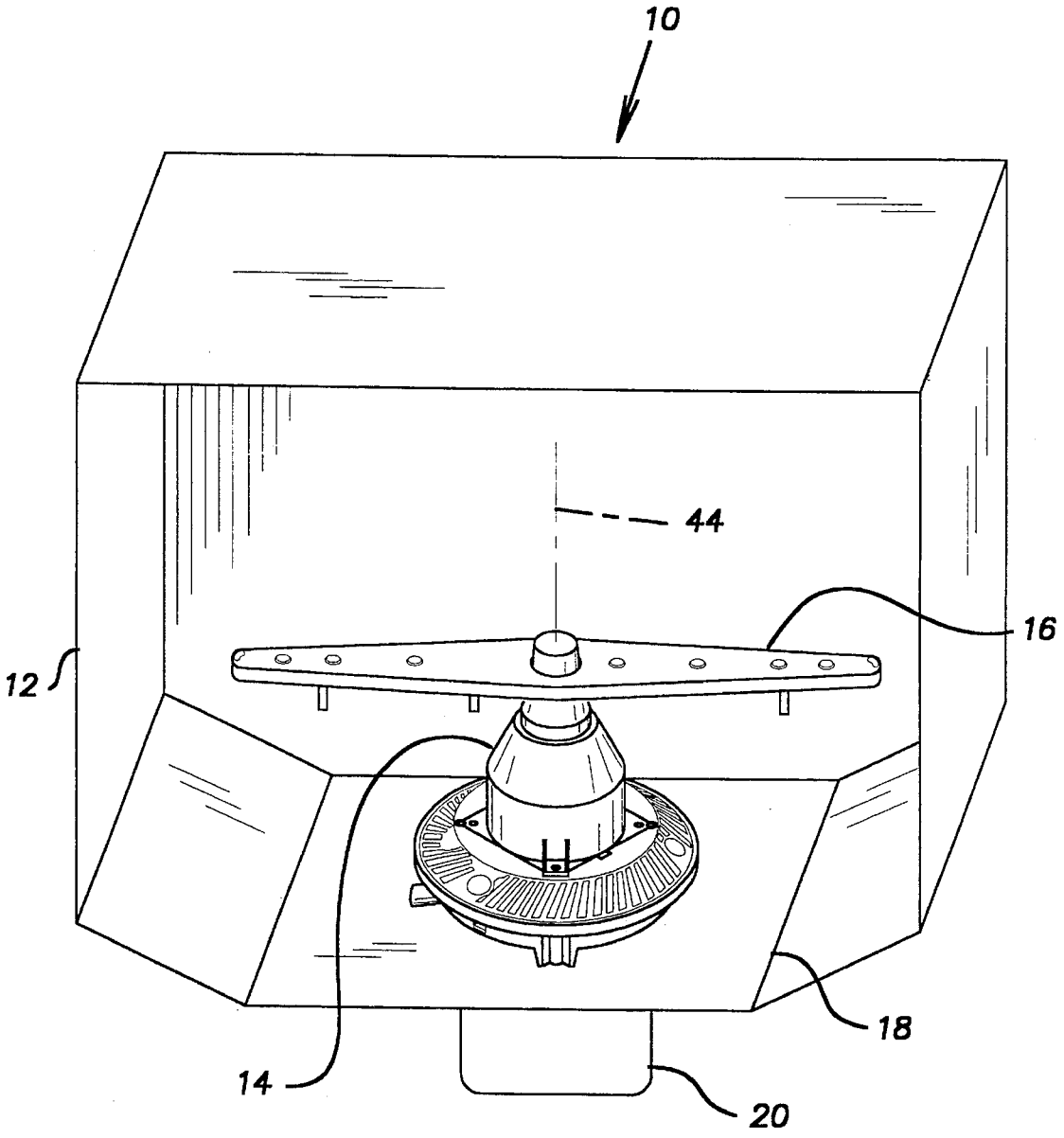
FIG. 1 is a perspective view of a dishwasher according to the present invention with items removed for clarity.

With reference to the drawing figures, components of a dishwashing machine 10 in accordance with the present invention are shown. The dishwashing machine 10 generally includes a tub 12, a pump assembly 14, and a spray or wash arm assembly 16. The tub 12, which includes means such as racks (not shown) to receive dishes, silverware, glasses, and the like, defines a sump 18 at a lower portion thereof. The pump assembly 14, which is mounted to the tub 12 at a bottom of the sump 18, is powered by an electric motor 20 and is generally operable to pump wash water from the sump 18 to the wash arm assembly 16 when operating in a recirculating mode, and to pump wash water from the sump 18 to a drain (not shown) when operated in a drain mode. Streams of dish-cleaning wash water project upwardly from the wash arm assembly 16 to the dishes in the racks and then fall to the sump 18 at the bottom of the tub 12. The wash arm assembly 16 includes a plastic wash arm 22 and a metal cover 24.

Figure 2:
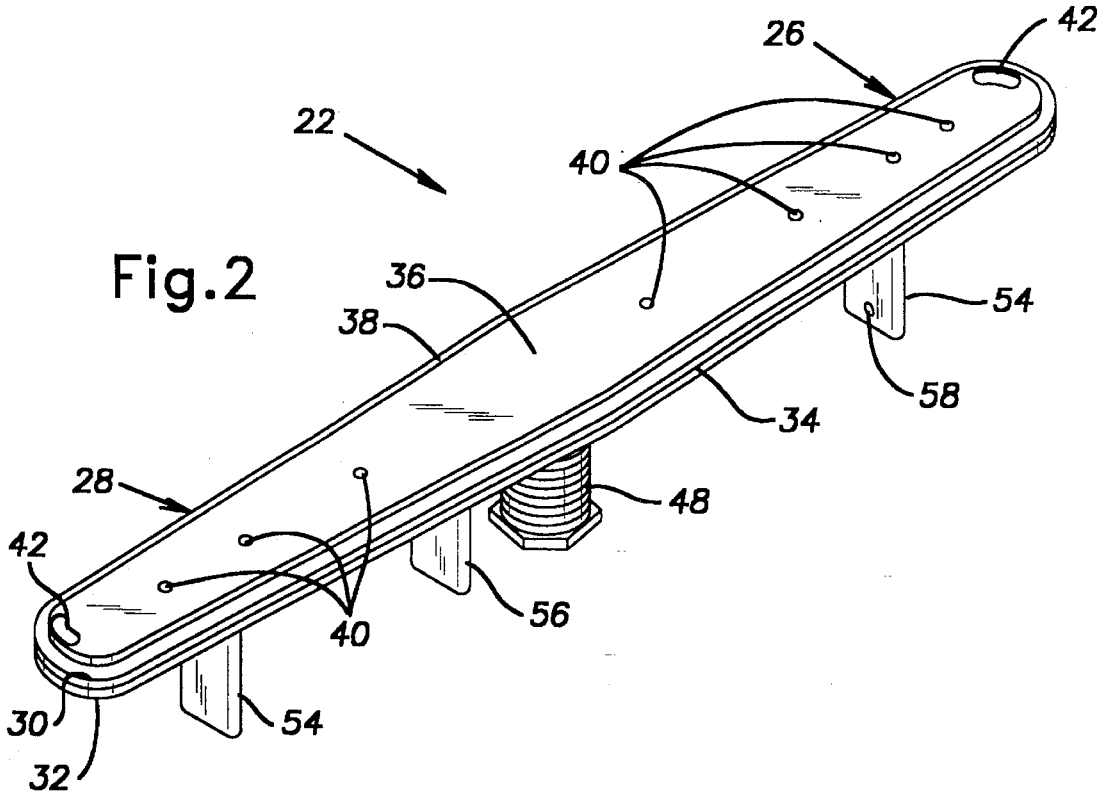
FIG. 2. is a perspective view of the top of a plastic wash arm.

FIG. 2 illustrates the plastic wash arm 22 which includes first and second arm portions 26, 28 extending in opposite directions and a generally hollow interior. The plastic wash arm 22 is preferably molded in upper and lower halves 30, 32 from a thermoplastic material such as polypropylene. The upper and lower halves 30, 32 are subsequently joined together by a process such as ultrasonic welding or the like to form a water-tight joint and thereby create the one-piece plastic wash arm 22. The upper and lower halves 30, 32 are preferably joined at a generally horizontal plane intersecting the lateral surfaces 34 of the first and second arm portions 26, 28.

A top surface 36 of the plastic wash arm 22 has an upwardly stepped portion 38 which is generally planar and extends across each of the arm portions 26, 28. The stepped portion 38 provides or defines a series of upwardly directed openings or wash jets 40, 42 through which the streams of dish-cleaning wash water project. The illustrated plastic wash arm 22 provides four circular wash jets 40 on the first arm portion 26 and three circular wash jets 40 on the second arm portion 28. Additionally, a generally crescent-shaped wash jet 42 is provided at the outer end of each of the arm members 26, 28. The wash jets 40, 42 are preferably adapted such that reaction forces are created by the water emanating from the wash jets 40, 42 to rotatably drive the wash arm assembly 16 about its axis of rotation 44. To achieve this result, some or all of the wash jets 40, 42 can be upwardly and outwardly directed. Preferably, the wash jets 40, 42 are adapted such that the wash arm assembly 16 rotates at about 20–22 revolutions-per-minute.

Naturally, the scope of the present invention is not limited to the specific pattern, shape, number, or size of the wash jets 40, 42 described herein. Rather, it is evident that any type or arrangement of wash jets 40, 42 may be employed to supply sprays of wash water to the dishes within the tub 12.

A generally planar bottom surface bottom surface 46 (FIG. 4) of the plastic wash arm 22 has a downwardly-directed cylindrical hub 48 at the intersection of the first and second arm portions 26, 28 which is generally coaxial with the vertical axis of rotation 44 of the wash arm assembly 16. The hub 48 includes a pair of resilient snap-fit clips 50 (FIG. 4) for mounting the wash arm assembly 16 to the pump assembly 14. The hub 48 forms an interior passage which communicates the hollow interior of the plastic wash arm 22 with an inlet 52 at a lower end of the hub 48. When the wash arm assembly 16 is mounted, the inlet 52 is in fluid communication with an outlet (not shown) of the pump assembly 14.

The bottom surface 46 of the plastic wash arm 22 also provides downwardly directed, generally rectangularly-shaped, extensions 54, 56. Each of the extensions 54, 56 provide or define an opening or wash jet 58, 60 through which a stream of filter-cleaning wash water projects. An outer extension 54 is provided near the outer end of each of the arm portions 26, 28. Each outer extension 54 defines a wash jet 58 which provides an inwardly and generally horizontal stream of wash water. An inner extension 56 is provided near the hub 48 on the second arm portion 28. The inner extension 56 defines a wash jet 60 which provides an downwardly and generally vertical stream of wash water. Together, the clean-out wash jets 58, 60 operate to clean a filter at the inlet of the pump assembly 14.

Figure 3:
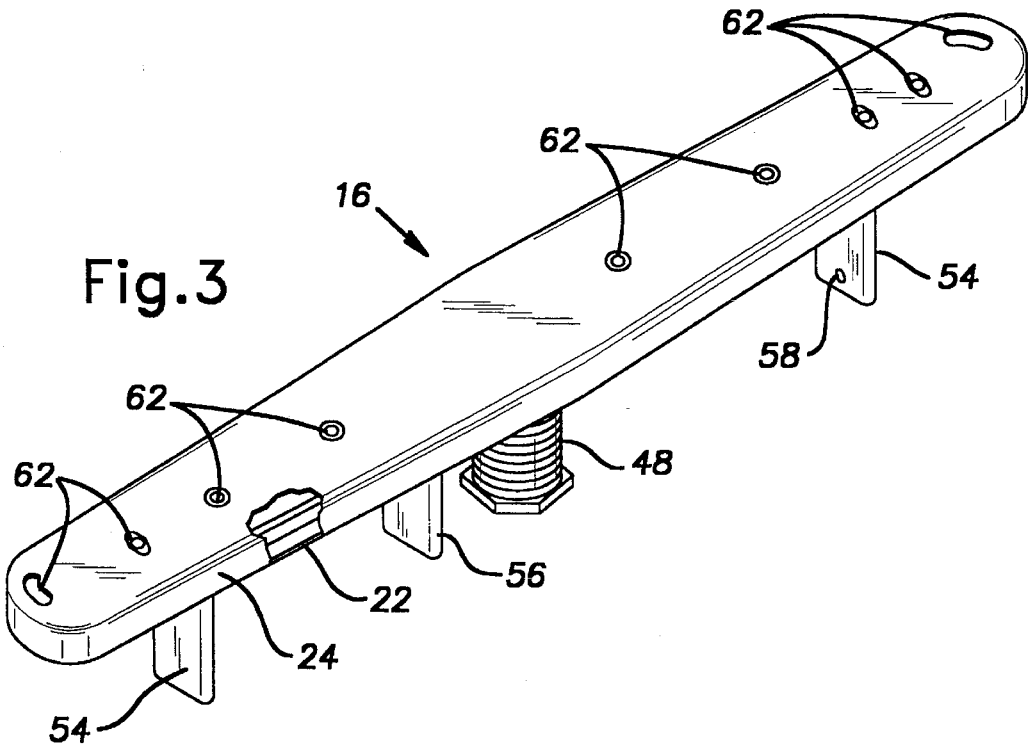
FIG. 3 is a perspective view of the top of the plastic wash arm of FIG. 2 with a metal cover according to the present invention.
Figure 4:
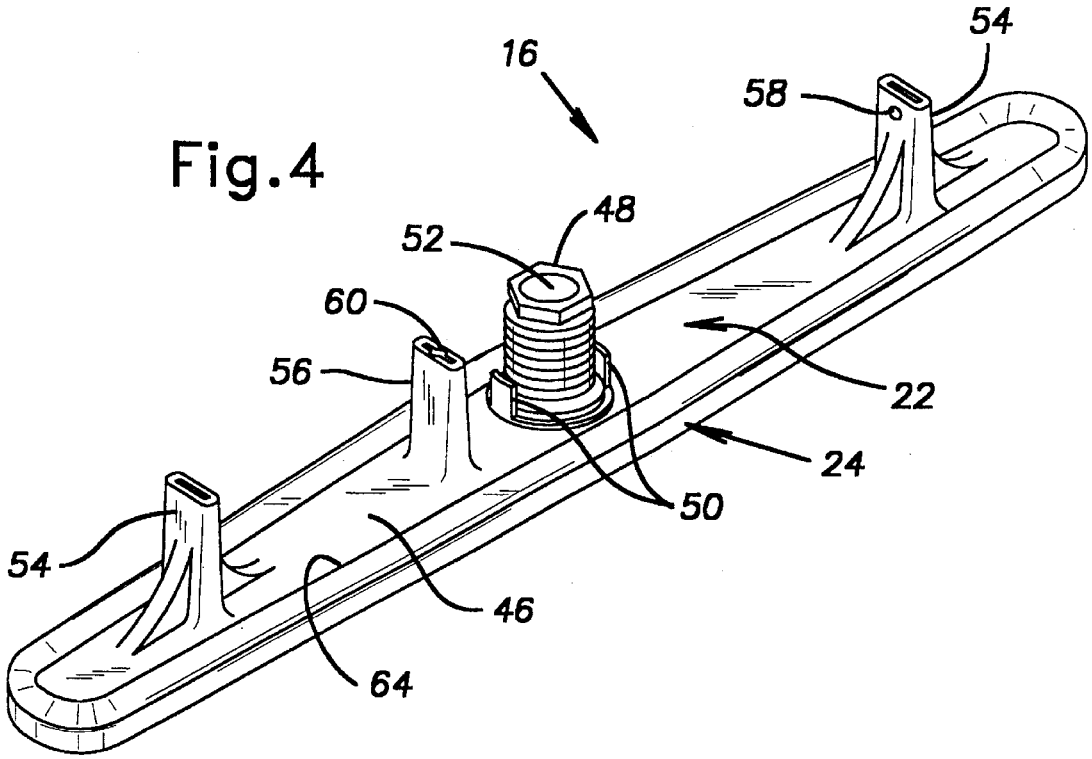
FIG. 4 is a perspective view of the bottom of the plastic wash arm with the metal cover of FIG. 3.

FIGS. 3 and 4 illustrate the wash arm assembly 16 with the metal cover 24 installed on the plastic wash arm 2. The one-piece metal cover 24 is preferably formed from stainless steel but other suitable metals can be alternatively utilized. The metal cover 24 wraps over the top surface 36 of the plastic wash arm 22, around the lateral surfaces 34 of the plastic wash arm 22, and over a portion of the bottom surface 46 of the plastic wash arm 22. As best shown in FIG. 3, the metal 24 cover substantially covers the entire top and lateral surfaces 36, 34 of the plastic wash arm 22. The portion of the metal cover 24 over the top surface 36 of the plastic wash arm 22 is generally planar and defines clearance openings 62 aligned with the wash jets 40, 42. The openings 62 are sized, shaped, and positioned such that the metal cover 24 does not interfere with the streams of wash water from the wash jets 40, 42. The metal cover 24 includes a generally continuous and inwardly directed flange 64 around the periphery of the bottom surface 46 of the plastic wash arm 22. The flange 64 engages the bottom surface 46 of the plastic wash arm 22 to retain the metal cover 24 on the plastic wash arm 22. The metal cover 24 is preferably formed to substantially conform to the shape of the plastic spray arm 24. To this end, the metal cover 24 can be stamped directly onto the molded plastic spray arm 22.

Figure 5:
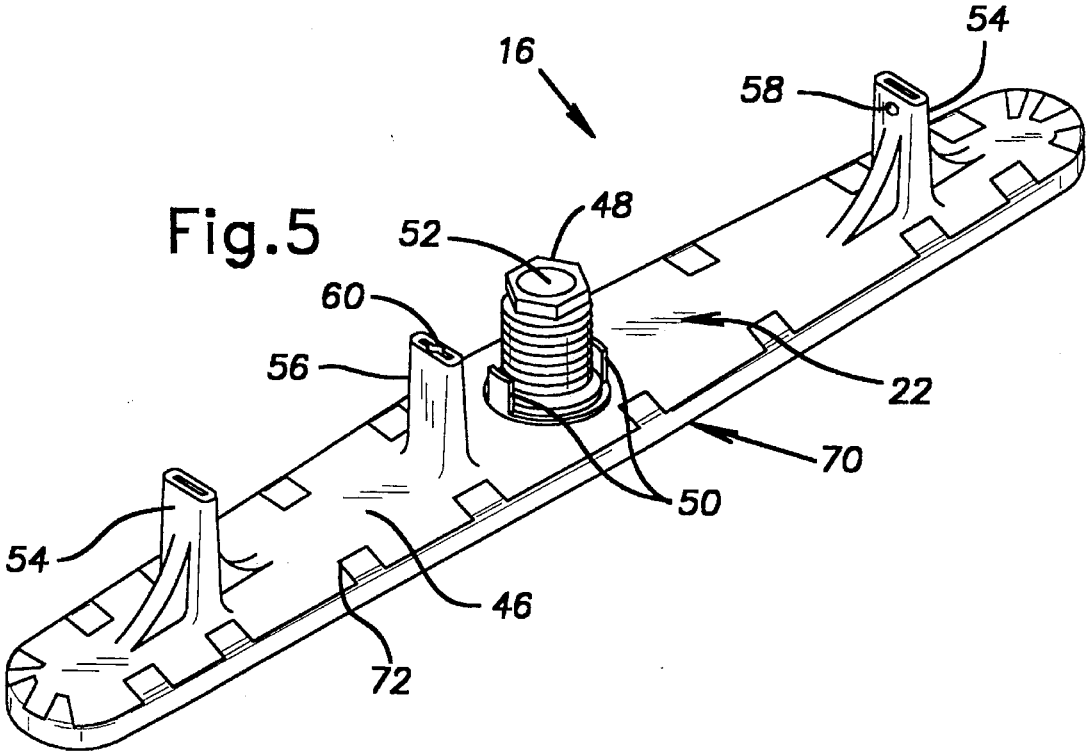
FIG. 5 is a perspective view, similar to FIG. 4, of the bottom of a second embodiment of the plastic wash arm with the metal cover.

FIG. 5 illustrates a metal cover 70 which is similar to the metal cover 24 of FIG. 4 except that the metal cover 70 is held onto the plastic wash arm 22 by a series of spaced apart inwardly extending tabs 72 at the bottom surface 46 of the plastic wash 22 arm rather than the generally continuous flange 64. FIG. 5 uses like reference numerals for like structure. The metal cover 70 illustrates that alternative means for attaching the metal cover 70 to the plastic spray arm 22 can be utilized.

It is noted that while the illustrated embodiments describe in detail a lower wash arm assembly 16, the present invention can also be utilized with upper or intermediate wash arm assemblies. With upper or intermediate wash arm assemblies, however, it may be desirable to form the metal cover 24 such that the metal cover 24 is also over substantially the entire bottom surface 46 of the plastic wash arm 22.

Although particular embodiments of the invention have been described in detail, it will be understood that the invention is not limited correspondingly in scope, but includes all changes and modifications coming within the spirit and terms of the claims appended hereto.

What is claimed is:

1. A dishwasher comprising:

a tub adapted to receive dishes to be washed and providing a sump to temporarily retain a quantity of water;

a pump assembly for circulating wash water from said sump throughout the tub;

a wash arm assembly rotatably mounted within said tub having a generally vertical axis of rotation, said wash arm assembly being generally hollow and receiving a portion of the wash water circulated by the pump assembly, said wash arm assembly including a plastic wash arm having a top surface, lateral surfaces, and a bottom surface, and a metal cover wrapping over said top surface and around said lateral surfaces of said plastic wash arm.

2. The dishwasher according to claim 1, wherein said top surface of said plastic wash arm defines a series of wash jets and said metal cover defines openings aligned with said wash jets.

3. The dishwasher according to claim 1, wherein said metal cover comprises stainless steel.

4. The dishwasher according to claim 1, wherein said metal cover wraps over at least a portion of said bottom surface of said plastic wash arm.

5. The dishwasher according to claim 1, wherein said metal cover includes a generally continuous flange at said bottom surface of said plastic wash arm.

6. The dishwasher according to claim 1, wherein said metal cover includes a series of spaced apart tabs at said bottom surface of said plastic wash arm.

7. The dishwasher to claim 1, wherein said metal cover is formed to substantially conform to a shape of said plastic wash arm.

8. The dishwasher according to claim 1, wherein said metal covers substantially all of said top surface and said lateral surfaces of said plastic wash arm assembly.

9. The dishwasher according to claim 1, wherein said plastic wash arm includes at least one extension downwardly extending from said bottom surface.

* * * * *